US005239970A

United States Patent [19]

Kurihara

[11] Patent Number: 5,239,970

[45] Date of Patent: Aug. 31, 1993

[54] FUEL INJECTION TYPE ENGINE

[75] Inventor: Noboru Kurihara, Hamamatsu, Japan

[73] Assignee: Sanshin Kogyo Kabushiki Kaisha, Hamamatsu, Japan

[21] Appl. No.: 638,823

[22] Filed: Jan. 8, 1991

[30] Foreign Application Priority Data

Jan. 9, 1990 [JP] Japan ..... 2-2380

[51] Int. Cl.[5] ..... F02M 23/00

[52] U.S. Cl. ..... 123/533

[58] Field of Search ..... 123/73 C, 531, 533, 123/26

[56] References Cited

U.S. PATENT DOCUMENTS 4,823,756 4/1989 Ziejewski et al. ..... 123/531
4,846,114 7/1989 List ..... 123/26
4,892,065 1/1990 List ..... 123/26

FOREIGN PATENT DOCUMENTS 63-179143 7/1988 Japan ..... 123/533

*Primary Examiner*—Raymond A. Nelli
*Attorney, Agent, or Firm*—Ernest A. Beutler

[57] ABSTRACT

A fuel/air injection system for an engine wherein fuel is purged from the injector when the engine is shut down by supplying air under pressure for a limited period of time in that event.

2 Claims, 3 Drawing Sheets

FUEL INJECTION TYPE ENGINE

BACKGROUND OF THE INVENTION

This invention relates to a fuel injection type engine and more particularly to an improved injector and method of operating it for an air fuel injected internal combustion engine.

Fuel injection is obtaining considerable recognition, particularly for use in providing good fuel economy and emission control for two cycle engines wherein fuel is injected directly into the combustion chamber of the engine. Frequently the type of fuel injector employed also injects high pressure air along with the fuel for a variety of reasons.

Although this type of injection system has some advantages, it has certain disadvantages, particularly in conjunction with some applications for two cycle engines. Such engines are frequently used with the type of small watercraft where the watercraft may be started and stopped repeatedly. This type of watercraft operation is quite common with those type of small watercraft in which the rider operates the watercraft in a swimming suit and frequently may be displaced from the watercraft due to its sporting nature. With such arrangement, the engine is stopped when the rider becomes displaced and then restarted when the rider returns to the watercraft and desires to continue operation.

The starting and stopping of fuel injected engines, however, present certain problems. When the engine is stopped, some residual fuel may be present in the injector and particularly around the injection nozzle, valve and valve seat associated therewith. This residual fuel will become heated to a high enough temperature to cause ionization even when the engine is not running due to the high residual heat within the combustion chamber. The carbonization of the fuel gives rise to particles which will then adversely affect the operation of the injector.

It is, therefore, a principal object of this invention to provide an improved fuel injection system wherein fuel will be purged from the injection nozzle during the time after the engine is shut off.

It is a further object to this invention to provide an improved air fuel injector system for an engine where the fuel supply is discontinued when the engine is shut down but the air supply is continued for a brief period of time thereafter in order to purge fuel from the injector.

SUMMARY OF THE INVENTION

This invention is adapted to be embodied in a fuel injection system for an internal combustion engine having a fuel injector adapted to spray fuel into the combustion chamber of the engine. In accordance with this invention, means are provided for sensing when the engine is stopped and means supplies a purging air flow to the fuel injector after the engine has stopped for a brief period of time to purge fuel from the injector.

DETAILED DESCRIPTION OF PREFERRED EMBODIMENT OF THE INVENTION

Figure 1:
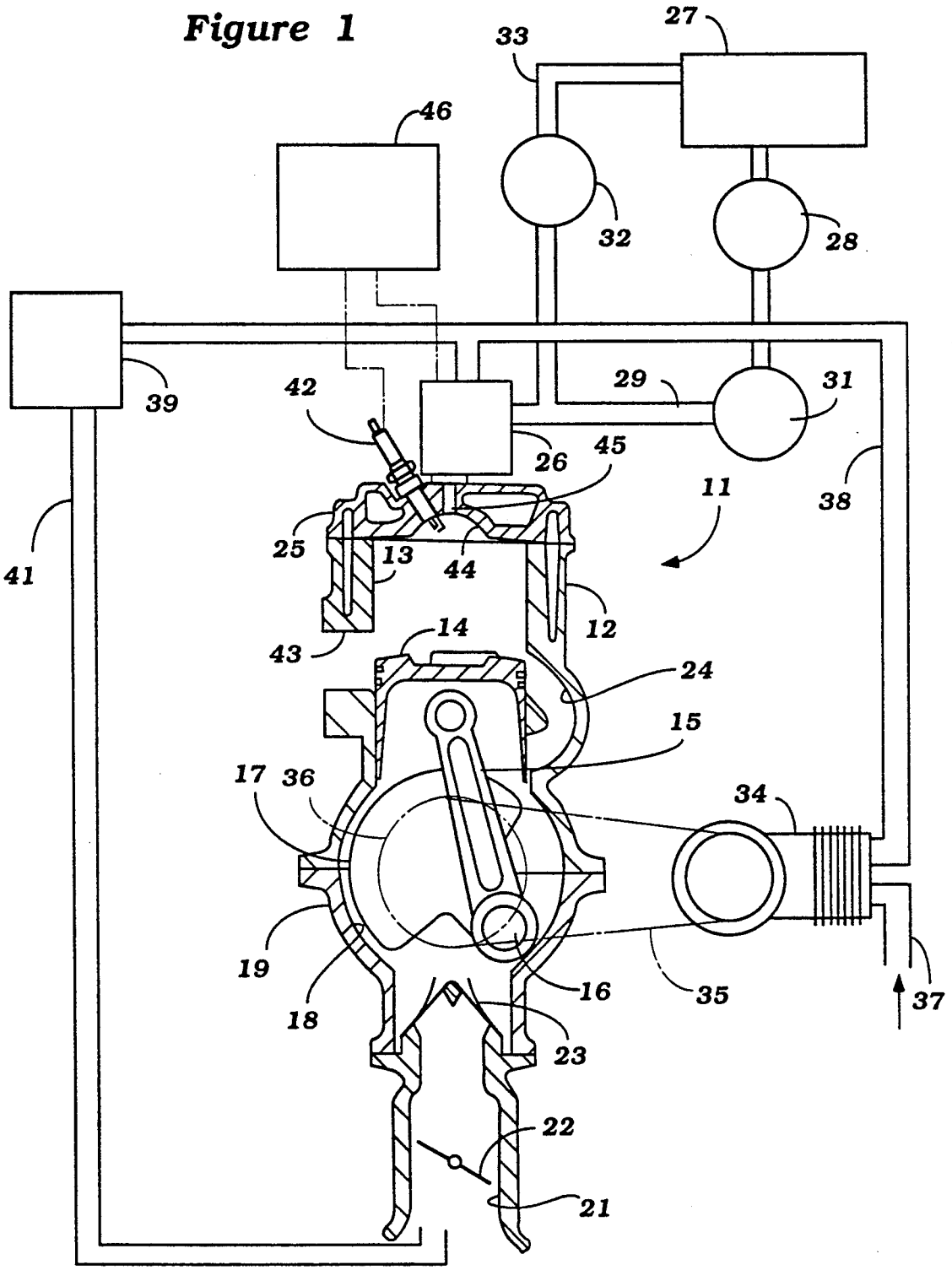
FIG. 1 is a partially schematic cross sectional view taken through the single cylinder of a two cycle internal combustion engine constructed in accordance with an embodiment of the invention.

Referring first to FIG. 1, a single cylinder of a three cylinder two-cycle crankcase compression internal combustion engine having a fuel/air injection unit constructed in accordance with an embodiment of the invention is identified generally by the reference numeral 11. Only a single cylinder of the engine 11 is depicted because it is believed that those skilled in the art can readily understand how the invention can be employed in connection with multiple cylinder engines. Also, although the invention is described in conjunction with a reciprocating engine, the invention cab be equally as well practiced with other types of engines and also engines that operate on other than the crankcase compression principal. However, the invention does have particular utility in conjunction with two-cycle engines.

The engine 11 includes a cylinder block 12 formed with a cylinder bore 13 in which a piston 14 reciprocates. The piston 14 is connected by means of a connecting rod 15 to a throw 16 of a crankshaft, indicated at 17 for driving the crankshaft in a known manner.

The crankshaft 17 is rotatably journaled within a crankcase chamber 18 that is formed by the cylinder block 12 and a crankcase 19 that is affixed to the cylinder block in any suitable manner. An air charge is delivered to the crankcase chamber 18 through an intake manifold 21 in which a flow controlling throttle valve 22 is positioned. A reed type check valve 23 is interposed between the intake manifold 21 and the crankcase chamber 18 so as to preclude reverse flow, as is well known in this art. The charge which has been admitted to the crankcase chamber 18 will be compressed during downward movement of the piston 14 and then is transferred to the combustion chamber through one or more scavenge ports 24.

A cylinder head 25 is affixed to the cylinder block 12 and supports a fuel/air injection unit, indicated generally by the reference numeral 26. The fuel/air injection unit may have any known type of construction, for example, as in one of the embodiments of co-pending application Ser. No. 544,422, filed Jun. 27, 1990, in the name of Chitoshi Saito, entitled Fuel Injection For Internal Combustion Engine and assigned to the assignee hereof.

Fuel is supplied to the fuel/air injection unit 26 from a remotely positioned fuel tank 27 by means of a fuel pump 28 and conduit 29. A fuel filter 31 is provided in this conduit 29 and filters the fuel delivered to the fuel/air injection unit 26. A pressure relief valve 32 is positioned in a return conduit 33 that leads back to the fuel tank 27 and which maintains a uniform head of fuel in the fuel/air injector unit 26 by bypassing excess fuel back to the tank 27.

Compressed air is delivered to the fuel/air injection unit 26 from an air compressor 34. The air compressor 34 is driven by means of a belt 35 from a pulley 36 that is affixed to the crankshaft 17 for rotation with it. The compressor 34 draws air from the atmosphere through an inlet 37 and delivers it to the fuel/air injection unit 26 by means of a supply conduit 38. The air pressure is regulated by a pressure regulator and accumulator 39 which regulates the air pressure by returning excess air to the induction manifold 21 through a bypass conduit 41.

A spark plug 42 is provided in the cylinder head 25 for firing the fuel/air charge generated both by the injector unit 26 and the induction system already described. The burnt fuel/air charge is then discharged to the atmosphere through an exhaust port 43.

Figure 2:
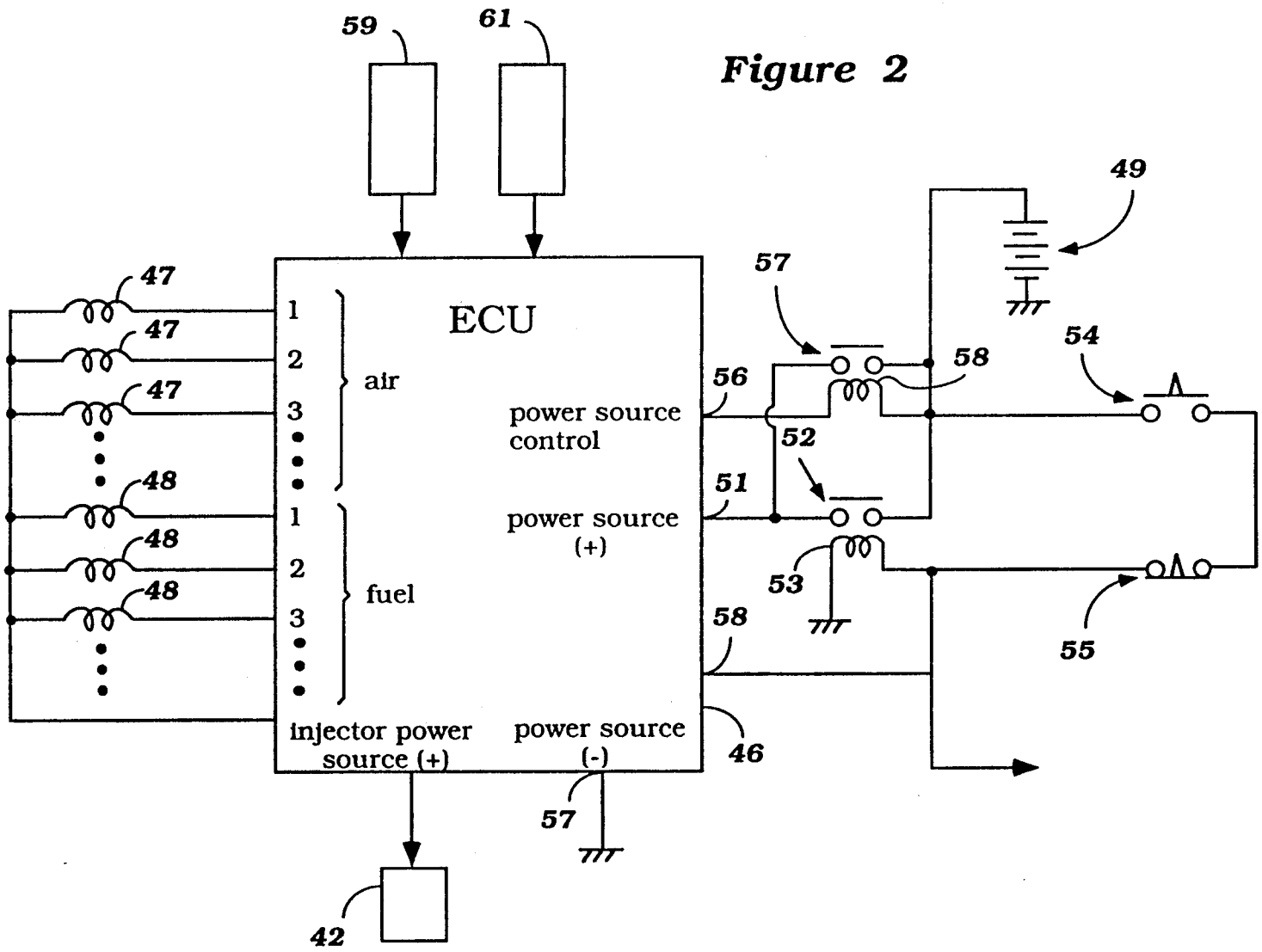
FIG. 2 is a block diagram showing the control circuit for an embodiment of the invention.

The fuel/air injector 26 injects fuel into a combustion chamber 44 formed in part by a recess in the cylinder head 25 through a delivery passage 45. The fuel/air injector 26 and spark plug 42 are controlled by a control unit, indicated generally by the reference numeral 46 and shown in most detailed in FIG. 2. Referring specifically to FIG. 2, the control unit 46 is an ECU that controls solenoid windings 47 for the air supply to the injectors 26. In the illustrated embodiment, the engine has three cylinders and hence there are three such windings 47. In addition, the fuel injectors of the fuel/air injectors 26 have solenoid windings 48 which are also energized by the ECU so as to provide the requisite amount of fuel. The ECU is powered by a battery 49 which is in circuit with a positive terminal 51 of the ECU 46 through a first main relay operated switch 52. The switch 52 is controlled by having its winding 53 in circuit with a main control switch 54 and a kill switch 55. The main control switch 54 receives power from a power terminal 56 of the ECU.

A second main relay 57 is in circuit with the battery 49 and the power source terminal 51 and has its winding 58 in circuit with the power control terminal 56 and the main control switch 54. The ECU also has a negative grounded terminal 57 and a further terminal 58 which is connected to another ground connection in circuit with the battery 49.

In operation, the kill switch 55 is normally closed and when the main control switch 54 is closed, the first main relay winding 53 will be energized and the switch 52 will be closed so as to power the terminal 51 of the ECU. At the same time, the winding 58 will be energized and the second main switch 57 will be closed to additionally provide power. The device will then operate in its normal method. The amount of air and fuel supplied to the engine is controlled by a variety of sensed parameters such as air flow indicated by a sensor 59 and throttle position, indicated by a sensor 61. A wide variety of other controls will be possible.

The particular strategy by which the air and fuel solenoids 47 and 48 are controlled during normal running may be of any known type. However, regardless of this system once the engine is shut off by either opening the kill switch 55 or the main switch 54, some residual fuel will be maintained in the air/fuel injector 26. In accordance with the invention, the ECU is programmed so as to operate the air solenoid windings 47 for a brief period of time after the engine has shut down so as to purge any fuel remaining from the air/fuel injector 26.

Figure 3:
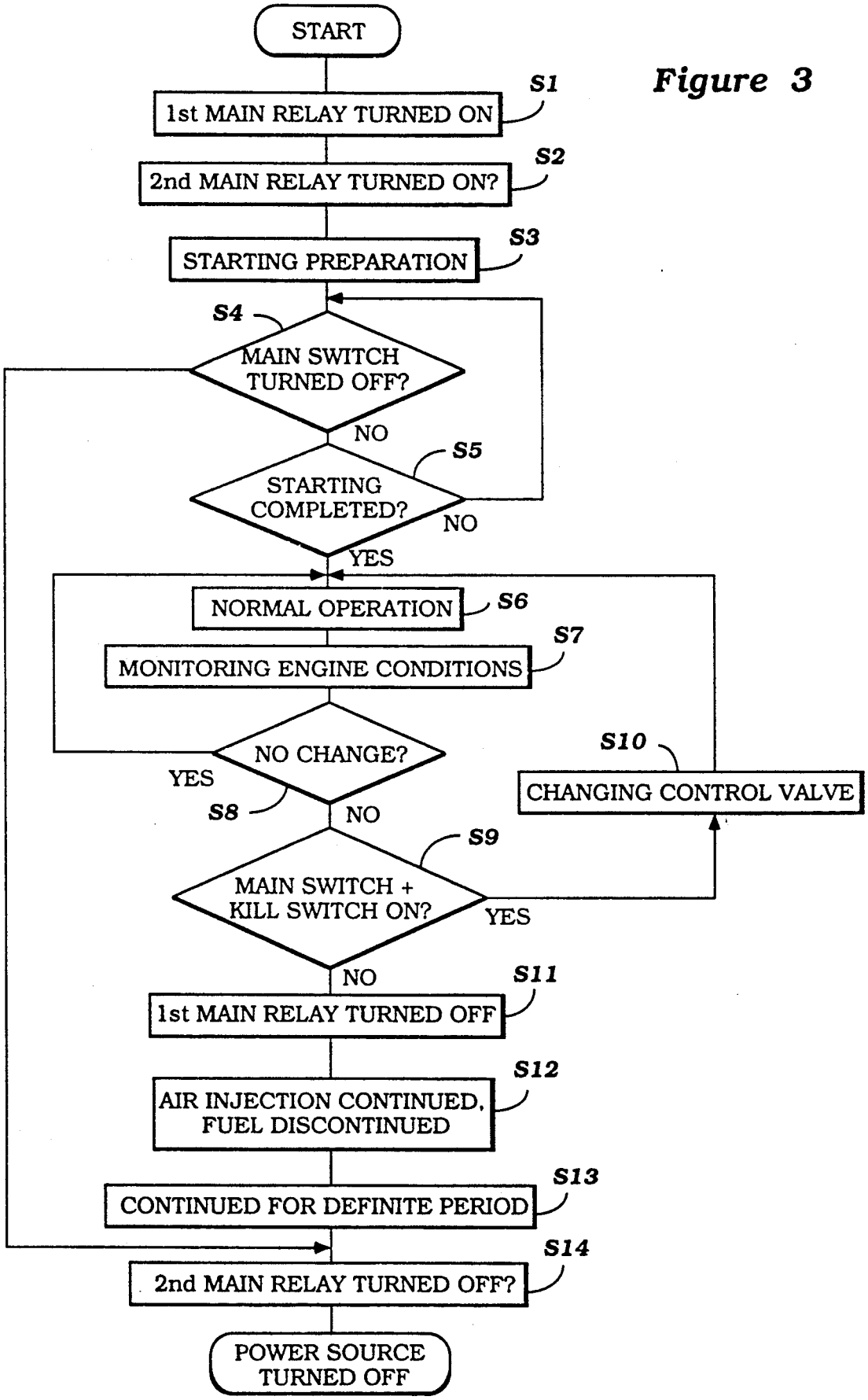
FIG. 3 is a flow chart showing the control routine of the embodiment.

The program by which this routine is accomplished may be best understood by reference to FIG. 3. When the program starts it moves to the step S1 to determine if the main relay 52 and specifically its winding 53 has been energized. The program then moves to the step S2 to determine that the second main relay 57 has been turned on through energization of its winding 58. The program then moves to the step S3 to prepare for the starting of the engine. The program then moves to the step S4 to determine if the main switch 54 has been turned off. If is has, the program jumps to the step S14 to turn the second main relay 57 off and discontinue power source.

However, if the main switch 54 has not been turned off, the program moves to the step S5 to confirm that starting has been completed. If it has, then the program moves to the step S6 to continue normal fuel injection operation. The program then continues through the step S7 to monitor engine conditions and to the step S8 to determine if there has been any change in engine conditions. If there has been a change, the program moves back to the step S6 and repeats. If at the step S8, it is determined that the engine operating conditions have not been changed then the program moves to the step S9 to determine that the main switch 54 and kill switch 55 are still turned on. If they are, the program moves to the step S10 to change the control value ratios for the changed engine running condition.

If, however, at the step S9 it is determined that the main switch or kill switch has been turned off, than the program moves to the step S11 to turn the first main relay 52 off. At this time, however, power will still be supplied to the ECU through the closed second main relay 57. The program than moves to the step S12 to discontinue the energization of the fuel solenoids 48 but continue to operate the air solenoids 47 for a time period so as to purge air from the injector units 26.

The program than continues for a pre-determined time and time period as set forth at the step S13 and then moves to the step S14 to turn off the second main relay 57 and discontinue the power to the control unit.

It should be readily apparent from the foregoing description that the described arrangement is effective in providing good air/fuel injection for an engine and also for purging fuel from the injection unit when the engine is shut off to avoid the possibility of carbon formations and other deleterious affects. Of course, the foregoing description is that of a preferred embodiment of the invention and various changes and modifications may be made without departing from the spirit and scope of the invention, as defined by the appended claims.

I claim:

1. A method of operating a fuel injector for injecting fuel directly into an internal combustion engine, wherein the fuel injector is a combined fuel/air injector and during normal running conditions, operates to inject both of fuel and air, with only air being injected for a brief period of time after the engine has been shut down, comprising the steps of sensing a preselected running condition of the engine and causing fuel to be purged from the fuel/air injector by applying compressed air through the fuel/air injector for the aforesaid brief period of time after the engine has been shut down.

2. A method of operating an air/fuel injector unit as set forth in claim 1 wherein the engine is spark ignited and wherein shutting down of the engine is sensed when the spark ignition is not initiated at the time when combustion would occur.

* * * * *